US005570636A

United States Patent [19]

Lewis

[11] Patent Number: 5,570,636

[45] Date of Patent: Nov. 5, 1996

[54] LASER-IMAGEABLE LITHOGRAPHIC PRINTING MEMBERS WITH DIMENSIONALLY STABLE BASE SUPPORTS

[75] Inventor: Thomas E. Lewis, E. Hampstead, N.H.

[73] Assignee: Presstek, Inc., Hudson, N.H.

[21] Appl. No.: 433,994

[22] Filed: May 4, 1995

[51] Int. Cl.[6] ..... B41N 1/08

[52] U.S. Cl. ..... 101/454; 101/457; 101/467

[58] Field of Search ..... 101/453, 454, 101/457, 460, 462, 463.1, 465–467, 401.1

[56] References Cited

U.S. PATENT DOCUMENTS

| | | | |
|---|---|---|---|
| 3,677,178 | 7/1972 | Gipe | 101/450.1 |
| 4,842,988 | 6/1989 | Herrmann et al. | 430/14 |
| 4,842,990 | 6/1989 | Herrmann et al. | 430/272 |
| 4,846,065 | 7/1989 | Mayrhofer et al. | 101/453 |
| 5,053,311 | 10/1991 | Makino et al. | 430/166 |
| 5,188,032 | 2/1993 | Lewis et al. | 101/453 |
| 5,339,737 | 8/1994 | Lewis et al. | 101/454 |
| 5,353,705 | 10/1994 | Lewis et al. | 101/453 |
| 5,378,580 | 1/1995 | Leenders | 101/467 |
| 5,379,698 | 1/1995 | Nowak et al. | 101/454 |

FOREIGN PATENT DOCUMENTS 1050805 3/1979 Canada .

OTHER PUBLICATIONS

Research Disclosure, Apr. 1980, at p. 131.

Nechiporenko et al., "Direct Method of Producing Waterless Offset Plates By Controlled Laser Beam".

*Primary Examiner*—Stephen R. Funk

*Attorney, Agent, or Firm*—Cesari and McKenna

[57] ABSTRACT

Laser-imageable lithographic printing members have rigid base supports that confer strength and rigidity. The supports may reflect imaging radiation so that radiation from an imaging pulse that passes through an imaging layer is returned to that layer, thereby augmenting the effective energy flux density. In the case of thermally conductive (e.g., reflective metal) base supports, heat is concentrated in the imaging layer by an underlying insulating layer interposed between the imaging layer and the base support.

8 Claims, 1 Drawing Sheet

LASER-IMAGEABLE LITHOGRAPHIC PRINTING MEMBERS WITH DIMENSIONALLY STABLE BASE SUPPORTS

BACKGROUND OF THE INVENTION

1. Field of the Invention

The present invention relates to digital printing apparatus and methods, and more particularly to lithographic printing plate constructions that may be imaged on- or off-press using digitally controlled laser output.

2. Description of the Related Art

U.S. Pat. Nos. 5,339,737 and 5,379,698 disclose a variety of lithographic plate configurations for use with imaging apparatus that operate by laser discharge (see, e.g., U.S. Pat. No. 5,385,092 and U.S. application Ser. No. 08/376,766, the entire disclosures of which are hereby incorporated by reference). These include "wet" plates that utilize fountain solution during printing, and "dry" plates to which ink is applied directly.

All of the disclosed plate constructions incorporate materials that enhance the ablative efficiency of the laser beam. This avoids a shortcoming characteristic of some prior systems, which employ plate substances that do not heat rapidly or absorb significant amounts of radiation and, consequently, do not ablate (i.e., decompose into gases and volatile fragments) unless they are irradiated for relatively long intervals and/or receive high-power pulses. The disclosed plate materials are all solid and durable, preferably of polymeric composition, enabling them to withstand the rigors of commercial printing and exhibit adequate useful lifespans.

In one disclosed embodiment, the plate construction includes a first layer and a substrate underlying the first layer, the substrate being characterized by efficient absorption of infrared ("IR") radiation, and the first layer and substrate having different affinities for ink or an ink-adhesive fluid. Laser radiation is absorbed by the substrate, and ablates the substrate surface in contact with the first layer; this action disrupts the anchorage of the substrate to the overlying first layer, which is then easily removed at the points of exposure. The result of removal is an image spot whose affinity for ink or the ink-adhesive fluid differs from that of the unexposed first layer.

In a variation of this embodiment, the first layer, rather than the substrate, absorbs IR radiation. In this case the substrate serves a support function and provides contrasting affinity characteristics.

In both of these two-ply plate types, a single layer serves two separate functions, namely, absorption of IR radiation and interaction with ink or an ink-adhesive fluid. In a second embodiment, these functions are performed by two separate layers. The first, topmost layer is chosen for its affinity for (or repulsion of) ink or an ink-adhesive fluid. Underlying the first layer is a second layer, which absorbs IR radiation. A strong, durable substrate underlies the second layer, and is characterized by an affinity for (or repulsion of) ink or an ink-adhesive fluid opposite to that of the first layer. Exposure of the plate to a laser pulse ablates the absorbing second layer, weakening the topmost layer as well. As a result of ablation of the second layer, the weakened surface layer is no longer anchored to an underlying layer, and is easily removed. The disrupted topmost layer (and any debris remaining from destruction of the absorptive second layer) is removed in a post-imaging cleaning step. This, once again, creates an image spot having an affinity for ink or an ink-adhesive fluid differing from that of the unexposed first layer.

An alternative to the foregoing constructions that provides improved performance in some circumstances is disclosed in the '698 patent, which contemplates use of a thin layer of metal, preferably titanium, as an ablation medium that is selectively destroyed by imaging pulses. Destruction of the titanium layer, which intervenes between an overlying top layer and a substrate, leaves the top layer unanchored and therefore vulnerable to removal by cleaning. The '698 and '737 patents, whose entire disclosures are hereby incorporated by reference, also disclose lamination of the substrate to a sturdy metal support.

This type of construction is well-suited to certain applications for which flexible substrates are not suitable. One such application involves special types of web presses, typically used by publishers of newspapers, that do not provide clamping mechanisms to retain printing plates against the plate cylinders. Instead, the leading and trailing edges of the plate are each crimped and inserted into a slot on the corresponding cylinder, so the plate is held against the surface of the cylinder by the mechanical flexion of the bent edges. Film or plastic materials cannot readily provide the necessary shape retention and physical strength to accommodate use in such presses. For example, while it may be possible to produce relatively permanent bends in a polyester substrate using heat-set equipment, such an approach may prove cumbersome and costly.

A second environment favoring use of metal substrates involves large-sized plates. The dimensional stability of plastic- or film-based plates tends to decrease with size unless the thickness of the substrate is increased; however, depending on the size of the plate, the amount of thickening necessary to retain acceptable rigidity can render the plate unwieldy, uneconomical or both. By contrast, metal substrates can provide high degrees of structural integrity at relatively modest thicknesses.

Plastic- or film-based plates also may not perform well in certain pressroom environments having high ambient particulate levels. Dust particles trapped between the plate cylinder and the plate can, during imaging or under the pressure produced by contact between the plate and the associated blanket cylinder, project through the plate substrate to produce raised points on the plate surface. Such points can create inaccuracies during plate imaging and also produce artifacts when ink is transferred from the plate.

The lamination approach discussed in the '698 and '737 patents facilitates the use of readily available heavy support layers that may contain surface imperfections; by contrast, were such a support used directly as a substrate, it would be necessary to employ expensive materials specially processed to remove any irregularities. However, while lamination may prove worthwhile from the perspectives of plate durability and strength, the procedure contemplated in the '698 and '737 patents adds nothing to imaging capability. Following lamination, the plate retains the same imaging characteristics as the unlaminated precursor.

Moreover, depending on various cost and performance considerations, it may be desirable to dispense with lamination entirely, or at least with the need for a substrate in addition to a base support. This omission is easily achieved in the case of polymeric base supports, of course, since these do not require lamination at all; all that is necessary is use of a heavier grade of film for the substrate. However, unlaminated plates having thermally conductive supports, such as aluminum or other metals, pose significant difficulties. Direct application of a titanium imaging layer, for example, to an aluminum support will in most cases prevent formation of an image due to conduction of heat through the support, which prevents sufficient energy from building up in the titanium layer to cause its ablation. Such conduction loss is avoided in the laminated constructions contemplated in the '698 and '737 patents due to the presence of an intervening polymeric substrate and layer of laminating adhesive.

One possible approach to preventing dissipation of energy is suggested in U.S. Pat. No. 5,353,705, which introduces a "secondary" ablation layer that partially volatilizes in response to heat generated by ablation of one or more overlying layers. However, the purpose of the secondary ablation layer is to provide a surface not suitable for deposition of debris, i.e., to which debris will not become attached. This is accomplished by formulating the secondary ablation layer to exhibit deliberate thermal instability and to partially decompose in response to temperatures generally above 200° C., thereby providing an inhospitable environment for debris deposition. Accordingly, this layer absorbs heat from a hot overlying imaging layer, and materials exhibiting this property naturally provide less than optimal choices to retain energy within such an overlying layer, since by design they act as energy sinks. Also, secondary ablation layers are typically used in conjunction with organic imaging layers, which produce significant quantities of ablation debris.

DESCRIPTION OF THE INVENTION

Objects of the Invention

Accordingly, it is an object of the present invention to provide laminated printing members configured to assist in the imaging process.

It is a further object of the invention to facilitate production of laser-imageable lithographic plate constructions having a variety of supports, including thermally conductive supports.

Still a further object of the invention is to facilitate use of thermally conductive supports without the need for a lamination and/or a polymeric substrate.

It is another object of the invention to prevent excessive heat transport in a laser-imageable lithographic plate construction, thereby affording use of low-power imaging lasers.

It is yet another object of the invention to provide heavy-duty lithographic members for wet and dry printing that can be imaged at low power.

Other objects will, in part, be obvious and will, in part, appear hereinafter.

The invention accordingly comprises an article of manufacture possessing the features and properties exemplified in the constructions described herein, all as exemplified in the following summary and detailed description, and the scope of the invention will be indicated in the claims.

Brief Summary of the Invention

The present invention enables rapid, efficient production of lithographic printing plates that include heavy-duty base supports, and which can be imaged using relatively low-power laser equipment; the approach contemplated herein may be applied to any of a variety of laser sources that emit in various regions of the electromagnetic spectrum. In particular, the plates of the present invention can be imaged with solid-state lasers as described in the '092 patent at pulse times in excess of 1 μsec, typically from 5–13 μsec, and longer if desired. As used herein, the term "plate" refers to any type of printing member or surface capable of recording an image defined by regions exhibiting differential affinities for ink and/or fountain solution; suitable configurations include the traditional planar lithographic plates that are mounted on the plate cylinder of a printing press, but can also include cylinders (e.g., the roll surface of a plate cylinder), an endless belt, or other arrangement.

All constructions of the present invention utilize materials that enhance the ablative efficiency of the laser beam. Substances that do not heat rapidly or absorb significant amounts of radiation will not ablate unless they are irradiated for relatively long intervals and/or receive high-power pulses. Generally, preferred imaging wavelengths lie in the IR, and preferably near-IR region; as used herein, "near-IR" means imaging radiation whose $lambda_{max}$ lies between 700 and 1500 nm. An important feature of the present invention is its usefulness in conjunction with solid-state lasers (commonly termed semiconductor lasers and typically based on gallium aluminum arsenide compounds) as sources of imaging radiation; these are distinctly economical and convenient, and may be used in conjunction with a variety of imaging devices. The use of near-IR radiation facilitates use of a wide range of organic and inorganic absorption materials.

In a first aspect, the invention concerns plate constructions having base supports that reflect imaging radiation. In this way, unabsorbed radiation passing through the imaging layer is reflected back thereto, augmenting the effective energy flux density through the imaging layer, enhancing the ablation process and lowering laser power requirements. In one embodiment, the base support is itself reflective. In another embodiment, the base support is ordinarily non-reflective but is treated (e.g., metallized) to render it reflective to imaging radiation.

In a second aspect, the invention facilitates use of thermally conductive (e.g., metal) base supports by concentrating heat in the imaging layer, preventing (or at least retarding) its transmission and loss into the base support. To accomplish this, a thermally insulating layer is interposed between the imaging layer and the thermally conductive base support.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
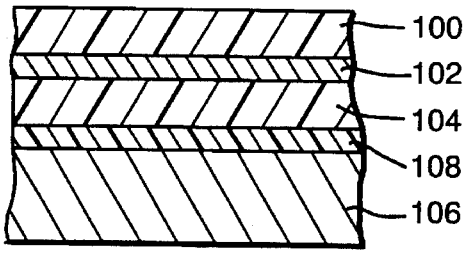
FIG. 1 is an enlarged sectional view of a lithographic plate having a top layer, a radiation-absorptive layer, and a substrate laminated to a dimensionally stable support.

Refer first to FIG. 1, which shows the construction of a first type of printing member in accordance with the present invention. The member includes a polymeric surface layer 100, a layer 102 capable of absorbing imaging radiation, a substrate 104, and a base support 106 that reflects imaging radiation. Substrate 104 is anchored to base support 106 by means of a laminating adhesive. Both substrate 104 and laminating adhesive 108 are transparent to imaging radiation. Layers 100 and 104 exhibit opposite affinities for fountain solution and/or ink. In a dry plate, layer 100 is "adhesive" or repellent to ink, while substrate 100 is oleophilic and therefore accepts ink. Suitable oleophobic materials for layer 100 include, for example, silicone and fluoropolymers; layer 104 can be, for example, polyester. In a wet plate, layer 100 is hydrophilic and accepts fountain solution, while layer 104 is both hydrophobic and oleophilic. Suitable hydrophilic materials for layer 100 include, for example, chemical species based on polyvinyl alcohol. Suitable formulations of both polymer systems are set forth in detail in the '737 patent. Ordinarily, layer 100 does not ablatively absorb imaging radiation.

In a preferred form of this construction, layer 102 is at least one very thin (preferably 250 Å or less) layer of a metal, preferably titanium, deposited onto a polyester substrate 104. Exposure of this construction to a laser pulse ablates the thin metal layer and weakens the topmost layer and destroys its anchorage, rendering it easily removed. The detached topmost layer 100 (and any debris remaining from destruction of the imaging layer 102) is removed in a postimaging cleaning step.

Because such a thin metal layer may be discontinuous, it can be useful to add an adhesion-promoting layer to better anchor the surface layer to the other (non-metal) plate layers, as described, for example, in the '698 patent. Suitable adhesion-promoting layers, sometimes termed print or coatability treatments, are furnished with various polyester films that may be used as substrates. For example, the J films marketed by E.I. duPont de Nemours Co., Wilmington, Del., and Melinex 453 sold by ICI Films, Wilmington, Del. serve adequately. Generally, the adhesion-promoting layer will be very thin (on the order of 1 micron or less in thickness) and, in the context of a polyester substrate, will be based on acrylic or polyvinylidene chloride systems. In addition, it should be substantially transparent to imaging radiation.

Titanium is preferred for thin-metal layer 102 because it offers a variety of advantages over other IR-absorptive metals. First, titanium layers exhibit substantial resistance to handling damage, particularly when compared with metals such as aluminum, bismuth, chromium and zinc; this feature is important both to production, where damage to layer 102 can occur prior to coating thereover of layer 100, and in the printing process itself where weak intermediate layers can reduce plate life. In the case of dry lithography, titanium further enhances plate life through resistance to interaction with ink-borne solvents that, over time, migrate through layer 100; other materials, such as organic layers, may exhibit permeability to such solvents and allow plate degradation. Moreover, silicone coatings applied to titanium layers tend to cure at faster rates and at lower temperatures (thereby avoiding thermal damage to substrate 104), require lower catalyst levels (thereby improving pot life) and, in the case of addition-cure silicones, exhibit "post-cure" cross-linking (in marked contrast, for example, to nickel, which can actually inhibit the initial cure). The latter property further enhances plate life, since more fully cured silicones exhibit superior durability, and also provides further resistance against ink-borne solvent migration. Post-cure cross-linking is also useful where the desire for high-speed coating (or the need to run at reduced temperatures to avoid thermal damage to substrate 104) make full cure on the coating apparatus impracticable. Titanium also provides advantageous environmental and safety characteristics: its ablation does not produce measurable emission of gaseous byproducts, and environmental exposure presents minimal health concerns. Finally, titanium, like many other metals, exhibits some tendency to interact with oxygen during the deposition process (vacuum evaporation, electron-beam evaporation or sputtering); however, the lower oxides of titanium most likely to be formed in this manner (particularly TiO) are strong absorbers of near-IR imaging radiation. In contrast, the likely oxides of aluminum, zinc and bismuth are poor absorbers of such radiation.

Preferred polyester films for use as substrate 104 in this embodiment have surfaces to which the deposited metal adheres well, exhibit substantial flexibility to facilitate spooling and winding over the surface of a plate cylinder, and are substantially transparent to imaging radiation. One useful class of preferred polyester material is the unmodified film exemplified by the MELINEX 442 product marketed by ICI Films, Wilmington, Del., and the 3930 film product marketed by Hoechst-Celanese, Greer, S.C. Also advantageous, depending on the metal employed, are polyester materials that have been modified to enhance surface adhesion characteristics as described above. Suitable polyesters of this type include the ICI MELINEX 453 product. These materials accept titanium, our preferred metal, without the loss of properties. Other metals, by contrast, require custom pretreatments of the polyester film in order to create compatibility therebetween. For example, vinylidenedichloride-based polymers are frequently used to anchor aluminum onto polyesters.

For traditional applications involving plates that are individually mounted to the plate cylinder of a press, the adhesion-promoting surface can also (or alternatively) be present on the side of the polyester film in contact with the cylinder. Plate cylinders are frequently fabricated from material with respect to which the adhesion-promoting surface exhibits a high static coefficient of friction, reducing the possibility of plate slippage during actual printing. The ICI 561 product and the dupont MYLAR J102 film have adhesion-promoting coatings applied to both surfaces, and are therefore well-suited to this environment.

The metal layer 102 is preferably deposited to an optical density ranging from 0.2 to 1.0, with a density of 0.6 being especially preferred. However, thicker layers characterized by optical densities as high as 2.5 can also be used to advantage. This range of optical densities generally corresponds to a thickness of 250 Å or less. While titanium is preferred as layer 102, alloys of titanium can also be used to advantage. The titanium or titanium alloy can also be combined with lower oxides of titanium.

Titanium, its alloys and oxides may be conveniently applied by well-known deposition techniques such as sputtering and electron-beam evaporation. Depending on the condition of the polyester surface, sputtering can prove particularly advantageous in the ready availability of co-processing techniques (e.g., glow discharge and back sputtering) that can be used to modify polyester prior to deposition.

Depending on requirements relating to imaging speed and laser power, it may prove advantageous to provide the metal layer with an antireflective overlay to increase interaction with the imaging pulses. The refractive index of the antireflective material, in combination with that of the metal, creates interfacial conditions that favor laser penetration over reflection. Suitable antireflective materials are well-known in the art, and include a variety of dielectrics (e.g., metal oxides and metal halides). Materials amenable to application by sputtering can ease manufacture considerably, since both the metal and the antireflection coating can be applied in the same chamber by multiple-target techniques.

The surface layer 100 is preferably a silicone composition, for dry-plate constructions, or a polyvinyl alcohol composition in the case of a wet plate. Our preferred silicone formulation is that described in connection with Examples 1–7 of the '698 patent, applied to produce a uniform coating deposited at 2 g/m$^2$. The anchorage of coating layer 100 to metal layer 102 can be improved by the addition of an adhesion promoter, such as a silane composition (for silicone coatings) or a titanate composition (for polyvinyl-alcohol coatings).

Layer 106 is a metal support. In a representative production sequence, a 2-mil polyester film is coated with titanium and then silicone, following which the coated film is laminated onto an aluminum base having a thickness appropriate to the overall plate thickness desired. In addition to conferring rigidity, lamination in accordance with the present invention includes reflection capability. Support 106 reflects unabsorbed imaging radiation that has passed through the imaging layer 102 and layers thereunder; in the case, for example, of near-IR imaging radiation, aluminum (and particularly polished aluminum) laminated supports provide highly advantageous reflectivity. In this instance, substrate 104, the laminating adhesive 108 and any other layers between layer 102 and support 106 (e.g., a primer coat), shown at 112 in FIG. 1 should be largely transparent to imaging radiation. In addition, substrate 104 should be relatively thin so that beam energy density is not lost through divergence before it strikes the reflective support. For proper operation in conjunction with the laser equipment described hereinabove, polyester substrates, for example, are preferably no thicker than 2 mils.

Figure 2:
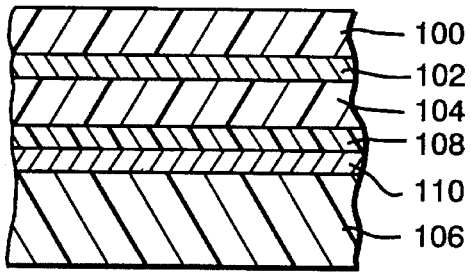
FIG. 2 is an enlarged sectional view of the construction shown in FIG. 1, wherein the base support is metallized so as to reflect imaging radiation.

Alternatively, a polyester support 106 can be metallized with a thin layer of a reflective metal, as shown in FIG. 2, before lamination. Such an arrangement exhibits substantial flexibility, and is therefore well-suited to plate-winding arrangements. Preferably, the reflective layer 110 is a reflective metal (e.g., aluminum) having a thickness from 200 to 700 Å or more, and support 106 is a heavy (e.g., 7-mil) polyester layer. Layer 110 can be deposited by vacuum evaporation or sputtering directly onto support 106; suitable means of deposition, as well as alternative materials, are described in connection with layer 178 of FIG. 4F in U.S. Pat. No. 4,911,075, the entire disclosure of which is hereby incorporated by reference.

Use of a reflective laminated support is particularly useful in the case of plates having titanium imaging layers, since these tend to pass at least some fraction of incident imaging radiation at the optical densities required for satisfactory performance. Moreover, titanium has been found to respond well to lamination, retaining its adhesion to under- and overlying layers notwithstanding the application of pressure and heat.

For applications involving automatic plate-material dispensing apparatus, the ease of winding the material around the cylinder represents an important consideration, and favors the use of support materials having low dynamic coefficients of friction with respect to the cylinder. Ideally, and to the extent practicable, the cylinder and the polyester surface in contact with it are matched to provide low dynamic but high static coefficients of friction. For this reason, it is important to consider both the dynamic and static behavior of any surface treatment in conjunction with a particular type of plate cylinder, and to evaluate this behavior against an unmodified surface.

Suitable techniques of lamination are well-characterized in the art, and are disclosed, for example, in U.S. Pat. No. 5,188,032, the entire disclosure of which is hereby incorporated by reference, and are also discussed below. In our production of printing members, we prefer to utilize materials both for substrate 104 and for support 106 in roll (web) form. Accordingly, roll-nip laminating procedures are preferred. In this production sequence, one or both surfaces to be joined are coated with a laminating adhesive, and the surfaces are then brought together under pressure and, if appropriate, heat in the nip between cylindrical laminating rollers.

Laminating adhesives are materials that can be applied to a surface in an unreactive state, and which, after the surface is brought into contact with a second surface, react either spontaneously or under external influence. In the present context, a laminating adhesive should possess properties appropriate to the environment of the present invention. As noted above, the adhesive should not absorb imaging radiation, both to permit reflection and to avoid undergoing thermal damage as a consequence of absorption; this is readily achieved for near-IR imaging radiation as discussed below. Another useful property is a refractive index not significantly different from that of the substrate 104 (which also, as earlier noted, should be largely transparent to imaging radiation).

In one embodiment, the laminating adhesive is thermally activated, consisting of solid material that is reduced to a flowable (melted) state by application of heat; resolidification results in bonding of the layers (i.e., substrate 106 and the support) between which the adhesive is sandwiched. Heat is supplied by at least one of the two rollers that form the laminating nip, and may be augmented by preheating in advance of the nip. The nip also supplies pressure that creates a uniform area contact between the layers to be joined, expelling air pockets and encouraging adhesive flow.

In a first implementation of this embodiment, adhesive may be applied as a solid (i.e., as a powder that is thermally fused into a continuous coating, or as a mixture of fluid components that are cured to a solid state following application) to one or both of the two surfaces to be joined; for example, a solid adhesive can be applied as a melt via extrusion coating at elevated temperatures, preferably at a thickness of 0.2–1.0 mil, although thinner and heavier layers can be utilized depending on the type of adhesive, application method and necessary bond strength. Following application, the adhesive is chilled and resolidified. Adhesives suitable for this approach include polyamides, copolymers of ethylene and vinyl acetate, and copolymers of ethylene and acrylic acid; specific formulas, including chemical modifications and additives that render the adhesive ideally suited to a particular application, are well-characterized in the art.

In a second variation, the adhesive is applied as a waterborne composition. In this case, it may be useful to treat the application surface to promote wetting and adhesion of waterborne materials. For example, in the case of a polyester substrate 104 that is to receive such a laminating adhesive, wettability can be improved by prior treatment with one or more polymers based on polyvinylidene dichloride.

In a third, preferred approach, the adhesive layer is cast from a solvent onto one or both of the two surfaces to be joined. This technique facilitates substantial control over the thickness of the applied layer over a wide range, and results in good overall surface contact and wetting onto the surface to which it is applied. Adhesives of this type can include cross-linking components to form stronger bonds and thereby improve cohesive strength, as well as to promote chemical bonding of the adhesive to at least one of the surfaces to be joined (ordinarily to a polymeric layer, such as a polyester substrate 104). They can also be formulated to include a reactive silane (i.e., a silane adhesion promoter) in order to chemically bond the adhesive to an aluminum support 106.

One useful family of laminating adhesives that may be cast is based on polyester resins, applied as solvent solutions, and which include a cross-linking component. A representative example of such a formulation is as follows:

| Component | Parts |
|---|---|
| Vitel 3550 | 36 |
| MEK (2-butanone) | 64 |
| Prepare solution, then add, just prior to coating: | |
| Mondur CB-75 | 4.5 |

Vitel 3550 is a polyester resin supplied by Shell Chemical Co., Akron, Ohio. Mondur CB-75 is an isocyanate cross-linker supplied by Mobay Chemical Corp., Pittsburgh, Pa.

This formulation is applied to the unprocessed side of a titanium-metallized, silicone-coated polyester film as described above, and the MEK solvent is evaporated using heat and air flow. The wet application rate is preferably chosen to result in a final dried weight of 10±g/m$^2$. However, it should be emphasized that a wide range of application weights will produce satisfactory results, and the optimal weight for a given application will depend primarily on the materials chosen for the support and substrate 104. The adhesive-coated film is laminated to an aluminum substrate of desired thickness, preferably using roll-nip lamination under heat and pressure.

An alternative to thermally activated laminating adhesives is the class of pressure-sensitive adhesives (PSAs). These are typically cast from a solvent onto the unprocessed side of substrate 104, dried to remove solvent, and finally laminated under pressure to a support. For example, the roll-nip laminating procedure described above can be utilized with no heat applied to either of the rollers. As in the case of thermally activated adhesives, post-application cross-linking capability can be included to improve bonding between surfaces and of the adhesive to the surfaces. The adhesive can also be applied, either in addition or as an alternative to application on substrate 104, to support 106. The PSA can be provided with additives to promote adhesion to support 106, to substrate 104, or to both.

Like thermally activated adhesives, PSAs can be applied as solids, as waterborne compositions, or cast from solvents. Once again, pre-treatment of an application surface to enhance wettability may prove advantageous.

Figure 3:
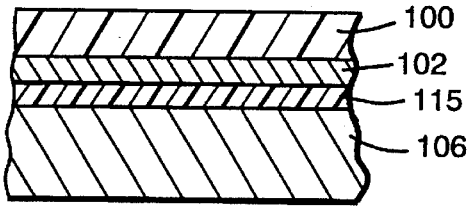
FIG. 3 is an enlarged sectional view of a lithographic plate having a top layer, a radiation-absorptive layer, a thermally insulting layer, and a thermally conductive, dimensionally stable support.

Refer now to FIG. 3, which illustrates a second type of printing member in accordance with the present invention. This construction omits the substrate 104. Because support 106 is thermally conductive, its immediate contact with imaging layer 102 (which may be metal, as illustrated in the figure, or fabricated from other materials such as polymers, as set forth in the '737 patent) will prevent the buildup of heat necessary for local ablation of layer 102. Accordingly, a thermally insulating layer 115 is interposed between imaging layer 102 and thermally conductive layer 106. This layer and surface layer 100 exhibit opposite affinities for ink and/or fountain solution.

Insulating layer 115 exhibits an inherent heat-transport rate much lower than that of a metal, and does not ablate in response to imaging radiation; in particular, preferred materials have coefficients of thermal conductivity no greater than 1% of the coefficient for aluminum (0.565 cal/cm-sec-° C.). Such materials include acrylic polymers (with a typical coefficient of 0.0005 cal/cm-sec-° C.), which can be used to formulate coatings, and polyethylene terephthalate (with a typical coefficient of 0.0004 cal/cm-sec-° C.), which provides the basis for most commercial polyester films. Although flexible polymeric materials are preferred, hybrid materials, which include flexible polymeric components and rigid inorganic components, can also be used to advantage. An example of such a hybrid material is a polysiloxane that includes an integral silicate structure within the polymer backbone.

Layer 115 can be applied directly to support 106 as a prime coat. Suitable formulations include:

| Component | Example 1 Parts | Example 2 Parts |
|---|---|---|
| Vitel 2200 | 12.5 | |
| P-84 polyamide solution | | 40.0 |
| 2-Butanone (methyl ethyl ketone) | 70.0 | |
| Toluene | 17.5 | |
| N-methylpyrrolidone (NMP) | | 15.0 |
| Tetrahydrofuran (THF) | | 70.0 |

where Vitel 2200 is a copolyester resin supplied by Shell Chemical Co., Akron, Ohio, and P-84 is a solution of 25% polyimide in NMP supplied by Lenzing Aktiengesellschaft, Lenzing, Austria.

In both examples, the solvents (MEK and toluene in example 1, and NMP and THF in example 2) are blended before adding the polymer component. The mixture is applied to aluminum stock utilized as support 106 at a coating weight of 1 g/m$^2$, and provides a final coating that is substantially transparent to IR imaging radiation. The formulation of example 2 exhibits better solvent and heat resistance than the formulation of example 1; both can be employed as metallizable base coats.

Use of either formulation as layer 115 facilitates imaging of otherwise unimageable constructions, as illustrated in the following table:

| Substrate | Material/Thickness | Results |
|---|---|---|
| Mill Coil | TiO/500 Å | Fails |
| Mill Coil/Primed | TiO/500 Å | Images |
| Lithographic | TiO/500 Å | Fails |
| Mill Coil | Ti/100 Å | Fails |
| Mill Coil/Primed | Ti/100 Å | Images |
| Lithographic | Ti/100 Å | Fails |

where mill coil refers to unmodified aluminum stock cleaned of rolling lubricant, and lithographic refers to grained and anodized aluminum; layer 102 was titanium or TiO; and layer 100 was the silicone coating described in Example 1 of the '737 patent, applied at 2 g/m$^2$ As indicated in the table, only the primed aluminum stock supported imaging.

Polymeric formulations suitable for insulating layer 115 can include pigments dispersed therein, although such pigments may enhance thermal conductivity and also interfere with reflection of imaging radiation back into layer 102.

Nonetheless, since the amount of heat actually conducted depends on exposure time as well as inherent heat-transfer capability, simply utilizing a sufficient thickness of moderately absorptive material may prevent heat from a very short imaging pulse from penetrating the layer and reaching support 106.

The concept of using thick layers of materials exhibiting only moderate insulating properties can be generalized to the use of thick absorbing layers 102; because of the very high heat-conduction properties of metal, this approach is best suited to polymeric absorbing layers. For example, depositing the above-noted carbon-black-loaded nitrocellulose layer to a thickness of more than 2 (and preferably about 3) $g/m^2$ results in absorbing layers that do not fully ablate in response to imaging radiation of the wavelength, duration and power levels described in the '092 patent. Instead, the imaging pulse digs a partial well into the absorbing layer, thereby detaching surface layer 100 and rendering it easily removed, and the unablated underlying thickness functions as does a separate layer 115. So long as the thickly applied absorbing layer and surface layer 100 exhibit opposite affinities for fountain solution and/or ink, the resulting construction, following imagewise exposure and cleaning, will perform as a lithographic printing member. In the case noted above, the nitrocellulose layer is oleophilic and surface layer 100 is oleophobic. The resulting performances of various thickness levels are shown in the following table:

| Substrate | Bulk Coating Wt/Thickness | Results |
|---|---|---|
| Mill Coil | 2.1 $g/m^2$/2 microns | Images |
| Lithographic | 2.1 $g/m^2$/2 microns | Images |
| Mill Coil | 1.0 $g/m^2$/1 micron | Images |
| Lithographic | 1.1 $g/m^2$/1 micron | Images |
| Mill Coil | 0.55 $g/m^2$/0.5 micron | Fails |
| Lithographic | 0.55 $g/m^2$/0.5 micron | Fails |

where mill coil refers to unmodified aluminum stock cleaned of rolling lubricant, and lithographic refers to grained and anodized aluminum; the material used for layer 102 was the carbon-black-loaded nitrocellulose polymer described in Example 1 of the '737 patent; and layer 100 was the silicone coating described in Example 1 of the '737 patent, applied at 2 $g/m^2$. As indicated in the table, sufficient material thickness for imaging layer 102 results in adequate insulating performance without a separate insulating layer. It should be noted that while the coatings applied at 1.0 and 1.1 $g/m^2$ do image successfully, the quality obtained with coating weights of at least 2 $g/m^2$ is significantly better.

It should also be emphasized that the conductive carbon black utilized in the foregoing examples provide particular benefits in the context of combining imaging and thermal-insulating functions in a single layer. We have found that we can achieve greater overall absorbance at lower pigmentation levels using conductive carbon blacks instead of traditional black pigments. Moreover, pigmentation with conductive carbon blacks results in imaging layers having considerable porosity and surface roughness. The former property enhances thermal insulation, and both properties promote intercoat adhesion with an overlying silicone layer through mechanical locking effects.

The foregoing constructions can be manufactured by, for example, coating insulating layer 115 onto thermally conductive support 106, applying layer 102 by coating (in the case of a polymer) or by well-known deposition techniques, e.g., sputtering, electron-beam evaporation and vacuum evaporation (in the case of a metal layer), and finally coating layer 100 onto the absorbing layer.

In another approach, layer 115 can represent a laminating adhesive, such as those described above, applied at sufficient thickness to achieve the requisite thermal insulation. Indeed, laminating adhesives are ordinarily organic polymers that exhibit substantial intrinsic thermal-insulating capacity, and can provide adequate insulation even at ordinary application weights. So long as their absorption of imaging radiation is minimal, they will not be ablated and will function as printing layers. For example, polyester-based adhesives are oleophilic and advantageously used with oleophobic surface layers.

It will therefore be seen that we have developed an effective approach to use of thermally conductive substrates in lithographic plate constructions that rely on heat for imaging. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A laminated lithographic printing member directly imageable by laser discharge, the member comprising:

a. a topmost first layer;

b. a second layer underlying the first layer and formed of a material subject to ablative absorption of imaging radiation whereas the first layer is not;

c. a third layer, substantially transparent to imaging radiation, underlying the second layer, the first and third layers exhibiting different affinities for at least one printing liquid selected from the group consisting of ink and an adhesive fluid for ink; and d. a support for reflecting imaging radiation and to which the third layer is laminated, the support comprising a material that reflects imaging radiation.

2. The member of claim 1 wherein the third layer is a laminating adhesive.

3. The member of claim 1 wherein the support is polished metal.

4. The member of claim 1 wherein the support is aluminum or an alloy of aluminum.

5. The member of claim 1 wherein the support is a metalized organic polymer.

6. The member of claim 1 further comprising a primer coating between the support and the third layer, the primer coating being substantially transparent to imaging radiation.

7. The member of claim 1 wherein the first layer is oleophobic and the third layer is oleophilic.

8. The member of claim 1 wherein the first layer is hydrophilic and the third layer is hydrophobic.

* * * * *